United States Patent [19]

Tokumoto et al.

[11] 4,049,530

[45] Sept. 20, 1977

[54] ELECTROLYZER

[75] Inventors: Shin-Ichi Tokumoto; Eiji Tanaka; Kenji Ogisu; Masahisa Enomoto, all of Yokohama, Japan

[73] Assignee: Sony Corporation, Tokyo, Japan

[21] Appl. No.: 617,185

[22] Filed: Sept. 26, 1975

[30] Foreign Application Priority Data

Sept. 30, 1974 Japan ..... 49-112537

[51] Int. Cl.[2] ..... C25D 21/10; C25D 21/02; C25C 3/00; C25C 7/00

[52] U.S. Cl. ..... 204/273; 204/243 R; 204/261

[58] Field of Search ..... 204/39, 145 F, 64 R, 204/239, 60, 243 R, 273, 274, 241, 261, 262, 222

[56] References Cited

U.S. PATENT DOCUMENTS

| | | | |
|---|---|---|---|
| 675,459 | 6/1901 | Yunck | 264/273 |
| 1,819,917 | 8/1931 | Niederreither et al. | 204/239 |
| 2,432,431 | 12/1947 | MacMullin | 204/239 |
| 3,024,174 | 3/1962 | Stetson | 204/241 |
| 3,170,861 | 2/1965 | Leibenzeder | 204/239 |
| 3,666,654 | 5/1972 | Garab | 204/274 |

FOREIGN PATENT DOCUMENTS

| | | | |
|---|---|---|---|
| 1,197,852 | 8/1965 | Germany | 204/273 |
| 397,565 | 8/1933 | United Kingdom | 204/239 |

*Primary Examiner*—T. M. Tufariello
*Attorney, Agent, or Firm*—Lewis H. Eslinger; Alvin Sinderbrand

[57] ABSTRACT

An electrolyzer is provided with a vessel containing an electrolyte and in which a lower temperature portion and a higher temperature portion are respectively defined, and with stirring devices or the like for forming circular flows of the electrolyte within the lower and higher temperature portions respectively and for circulating the electrolyte between the lower and higher temperature portions to permit the electrolysis to be carried out.

9 Claims, 7 Drawing Figures

ELECTROLYZER

BACKGROUND OF THE INVENTION

1. Field of the Invention

The present invention relates generally to an electrolyzer, and is directed more paticularly to an electrolyzer for use in electrodepositing a metal or alloy by fusion electrolysis by which the deposited metal, such as titanium, or an alloy can be given any desired shape such as a smooth, flat plate, a block or the like.

2. Description of the Prior Art

In the prior art electrodepositing by, fusion electrolysis, the deposited material is in a fused state, or in the form of dendrites, dendritic crystals, fine powders or sponge.

In order to avoid the foregoing problem, an improved electrodepositing method has been developed to provide an electrodeposited material which is, for example, of a smooth and flat shape. By way of example, the Japanese Pat. Nos. 212,080; 229,381; 294,943 and 726,754, some of whose inventors are the same as those of the present invention, disclose such an improved electrodepositing method.

The electrodepositing method described in the above Japanese Pat. No. 726,754 employs a fused-salt electrolyte containing at least (1) a mixture of the chloride salts of barium, magnesium, sodium and calcium having a freezing point of less than 600° C and (2) compounds of the desired metal. Portion A of the electrolyte is heated to a temperature more than at least 500° C and then adjusted in its state. The higher valent compound, for example, of titanium, in the electrolyte near an electrode on which the desired metal such as titanium is electro-deposited, is maintained at less than two-thirds of the lower valent compound of the desired metal, considered in molar ratio of analyzed value at the room temperature. Under such conditions, a electrodepositing is carried out at the temperature ranging between 400° and 580° C.

In such electrodepositing method, the composition of fused-salt electrolyte is important. It is also important that solid state particles, which are a part of the composition of the fused salt, be suspended in the fused-salt electrolyte. Further, the ion condition of the fused salt including the ions of the desired metal, the fused condition in the fused-salt and the condition of the constituents of the precipitated crystallites are also important.

It is important that the temperature distribution of the electrolyte in the electrolyzer provide at least two portions or zones, in one of which the cathode electrode is located and in the other of which there is maintained a relatively higher temperature.

More particularly, in the electrodepositing method being described, at the electrolytic temperature the composition of fused-salt electrolyte is an excess saturation composition. Accordingly, if all of the electrolyzer is maintained at the electrolytic temperature for a long time, excessively saturated components may be precipitated as crystallites and the crystallites may grow. Therefore, even if the electrolyte is stirred, it may become gradually impossible to keep the crystallites suspended or floating in the electrolyte. Further, the constituents of the crystallites of excessively saturated components are varied in response to the cooling thereof and, accordingly, the ion condition of the desired metal is also varied. If the ion of the desired metal is multivalent, the ion condition is greatly varied by a deproportional reaction, or by the formation of a complex salt or the like. Due to this fact, even if the molar ratio of fused salts at the location within the electrolyte where the cathode electrode is immersed can be held approximately constant at the electrolytic temperature, the state of the electrodeposited material is deteriorated in the course of a long continued electrolysis.

Accordingly, in order to desirably carry out an electrolysis well for a long time, it is necessary to heat the fused-salt electrolyte to more than at least the electrolytic temperature. For example in, an electrolyzer for electrodepositing metal titanium smoothly, there should be provided a low temperature portion which is maintained at an electrolytic temperature lower than the liquidus of fused-salt composition and at which a cathode electrode is located, and a higher temperature portion which is held at a temperature higher than the electrolytic temperature and which heats the electrolyte to such an extent that at least a part of the crystallites of excess fused-salt composition, which are formed at the electrolytic temperature, is fused to recover the function of the fused-salt.

SUMMARY OF THE INVENTION

Accordingly, it is an object of the present invention to provide an electrolyzer which can effectively perform the above described improved electrodepositing method.

It is another object of the invention to provide an electrolyzer with which electrodepositing can be effectively continued while the function of the fused-salt can be recovered continuously and automatically.

According to an aspect of the present invention, there is provided an electrolyzer which has a vessel defining therein lower temperature and high temperature portions, in which an electrolyte in such vessel forms circular or closed loop flows in the respective portions, and in which the electrolyte is also circulated between the lower and higher temperature portions to carry out electrolysis continuously.

The above, and other objects, features and advantages of the invention, will become apparent from the following description taken in conjunction with the accompanying drawings.

DESCRIPTION OF THE PREFERRED EMBODIMENTS

Figure 2:
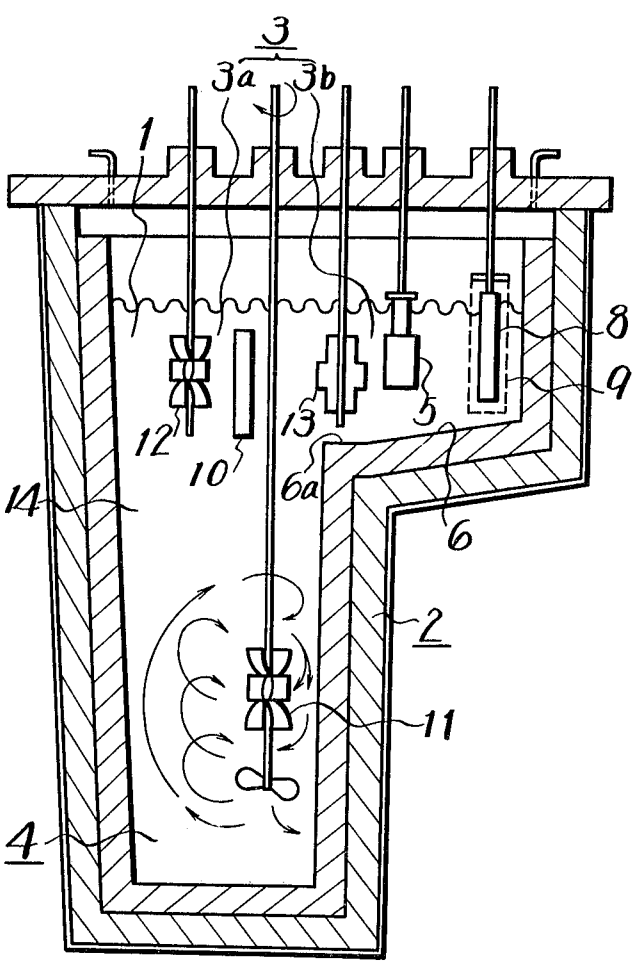
FIGS. 2, 3 and 4 are cross-sectional views respectively showing the flows imparted to an electrolyte in the electrolyzer shown in FIG. 1.

A first embodiment of an electrolyzer according to the present invention will now be described with reference to FIG. 1. The electrolyzer is shown to comprise a vessel 2 in which an electrolyte 1 is charged. In the vessel 2, a lower temperature portion 3 and a higher temperature portion 4 are respectively defined. In the lower temperature portion 3, the electrolyte 1 is maintained at a temperature lower than, for example, 500° C, preferably at a temperature ranging from 480° to 440° C, and a cathode electrode 5 is located in the portion 3.

In the higher temperature portion 4, the electrolyte 1 is maintained at a temperature that is sufficiently high for fusing the composition components of the electrolyte 1, for example, at a temperature higher than 500° C, and preferably at a temperature ranging from 520° to 560° C, to recover the function of the electrolyte 1. Suitable stirring devices, or stirrers which will be described later, are provided to produce circular flows of a closed loop type in the electrolyte 1 in the lower and higher temperature portions 3 and 4, respectively, and at the same time to produce an overall circular flow or circulation in the electrolyte 1 between the portions 3 and 4.

It may be possible to provide a cooling section 3*a* in the lower temperature portion 3 at a position upstream with respect to the overall flow or circulation of the electrolyte 1 through such portion 3. The cathode electrode 5 is located in the portion 3 of vessel 2 at a position other than the cooling section 3*a* and which is downstream from the latter with respect to the overall flow or circulation through lower temperature portion 3. Such section 3*b* of the lower temperature portion 3 in which the cathode electrode 5 is located is hereinafter referred to as the electrolytic section. A circular flow of closed loop type is formed between the cooling section 3*a* and the cathode or electrolytic section 3*b*, and at the same time a circular flow of the electrolyte 1 is formed by circulating the electrolyte 1 from the higher temperature portion 4 through the lower temperature portion 3 and back to the portion 4. By the formation of circular flows of electrolyte 1 in the respective portions 3*a*, 3*b*, and 4, the electrolyte 1 can be made to remain in the portions 3*a*, 3*b* and 4, respectively, for predetermined periods of time.

The higher temperature portion 4 is provided, for example, at the bottom part of a relatively deep side of the vessel 2, and the upper part of such deep side above the portion 4 is made the cooling section 3*a* of the lower temperature portion 3. The other side of vessel 2 is shallow to define the cathode or electrolytic section 3*b* of the lower temperature portion 3 in side-by-side relation to the cooling section 3*a*. The bottom surface 6 of the cathode or electrolytic section 3*b* forms a shelf which is inclined downwardly toward the portion 4. It is preferred that an edge 6*a* of the bottom surface 6 at the side of the portion 4 is formed with an inclination or bevel down to the portion 4 as shown by the dotted line 6*b*.

The cathode electrode 5 located in the lower temperature portion 3 can be moved, for example, rotated or subjected to a precession. An anode electrode 8 is located in the vessel 2 opposing the cathode electrode 5. In the example of FIG. 1, a partition membrane 9 made of a twilled quartz is located in the vessel 2 to surround the anode electrode 8 and thereby prevent the composition of the electrolyte 1 from being changed by the products produced by the anode reaction during the electrolysis.

A separator 10, with or without bores, may be located in the vessel 2 between cooling section 3*a* and cathode or electrolytic section 3*b* of the lower temperature portion 3.

The respective temperatures of the electrolyte 1 in the portions 3*a*, 3*b* and 4 of the vessel 2 are selected or determined by an internal heating type heater (not shown) to be at desired temperatures or to provide a desired temperature distribution in the vessel 2.

Means may be provided for cooling the electrolyte 1 in the cooling section 3*a*, if necessary. By way of example, though not shown, one end of a pipe may be inserted into the cooling section 3*a* of the vessel 2 from the outside thereof and an inert gas, such as an argon gas may be conducted to the section 3*a* through the pipe to form bubbles in the electrolyte 1 to thereby cool the electrolyte 1 in the section 3*a*.

The stirrers, which produce circular or closed loop flows of the electrolyte 1 in the respective portions 3*a*, 3*b* and 4 and makes parts of the circular flows circulate among the portions 3*a*, 3*b* and 4, may be constituted by at least two rotary blade mechanisms each of which is, for example, in the form of a propeller screw or helical screw. In the illustrated example of FIG. 1, three rotary blade mechanisms 11 to 13 are employed. By way of example, the first rotary blade mechanism 11 is disposed in the bottom part of the deep side, that is, the higher temperature portion 4 of the vessel 2, the second rotary blade mechanism 12 is disposed in the cooling section 3*a*, and the third rotary blade mechanism 13 is disposed in the cathode or electrolytic section 3*b*, as shown on FIG. 1.

Figure 4:
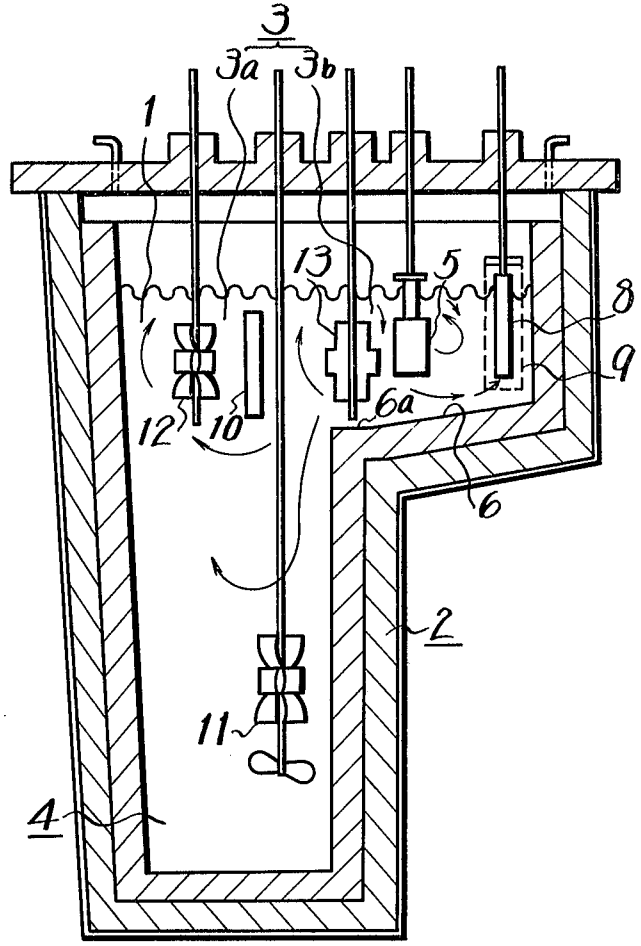
Figure 3:
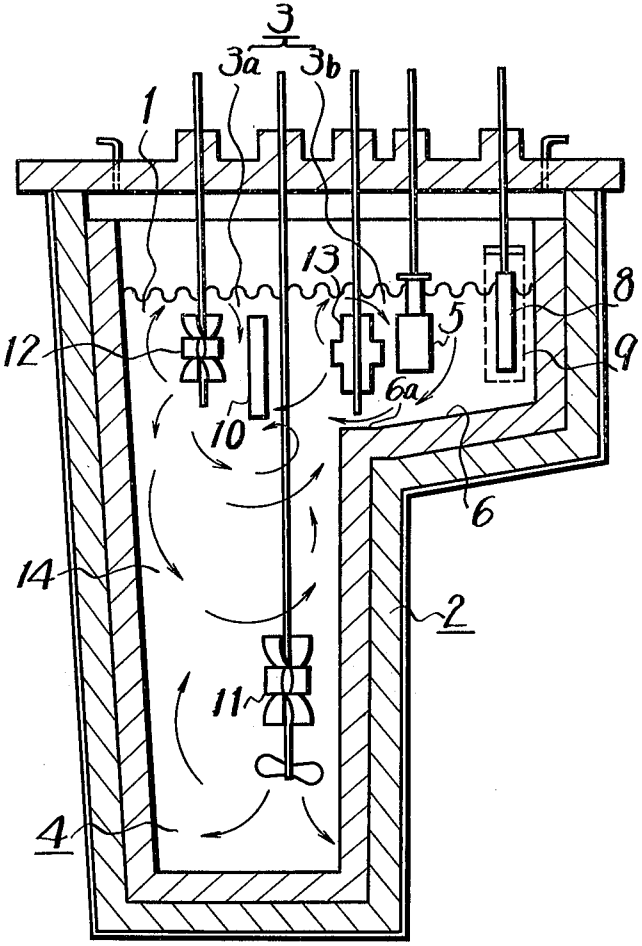

The operations of the blade mechanisms 11 to 13 will be now described. When only the first rotary blade mechanism 11 is driven or rotated, a circular flow can be formed in the electrolyte 1 mainly in the lower part of the deep side or higher temperature portion 4 of the vessel 2 as shown by the arrows on FIG. 2. When only the second rotary blade mechanism 12 is rotated, a circular flow can be formed in the electrolyte 1 mainly in the cooling section 3*a* of the lower temperature portion 3 as shown by the arrows on FIG. 3. Further, when only the third rotary blade mechanism 13 is rotated, a circular flow can be formed in the electrolyte 1 mainly in the cathode or electrolytic section 3*b* of the lower temperature portion 3 as shown by the arrows on FIG. 4. If the rotational speed, efficiency, rotational direction and so on of the first to third rotary blade mechanisms 11 to 13 are suitably selected in consideration of the viscosity and specific gravity of the electrolyte 1, the shape of the vessel 2 and so on, the circular flows are formed in the electrolyte 1 in the respective portions 3*a*, 3*b* and 4, as described above in connection with FIGS. 2 to 4, and at the same time parts of the respective circular flows can be circulated among the portions 3*a*, 3*b* and 4 or through the vessel 2.

Figure 1:
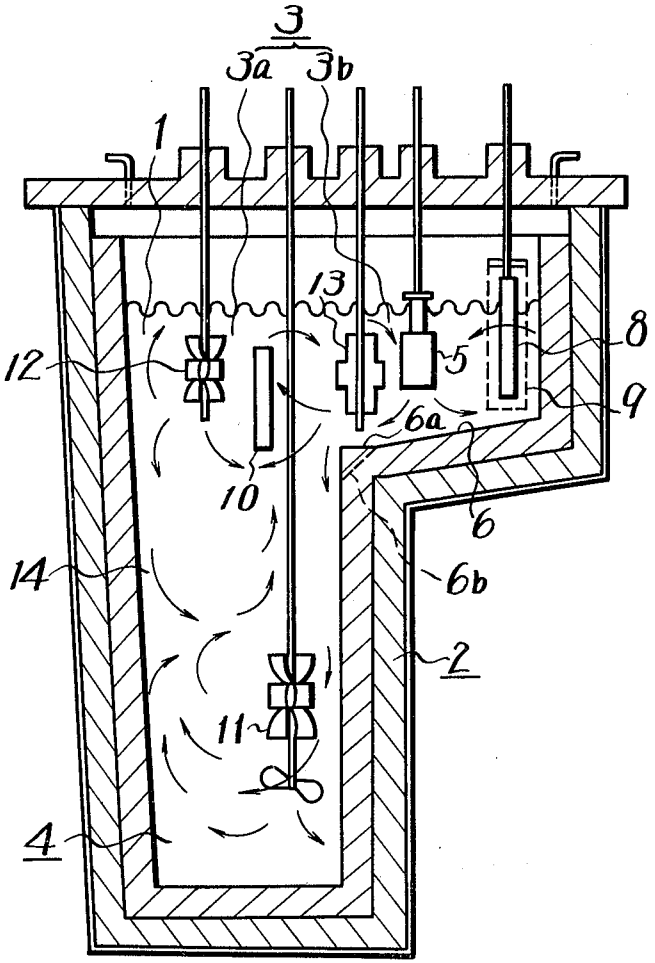
FIG. 1 is a cross-sectional view showing an electrolyzer according to an embodiment of the present invention.

Accordingly, when the first to third rotary blade mechanisms 11 to 13 are driven simultaneously and their rotary speeds, efficiencies, rotational directions and so on are selected in consideration of the viscosity and specific gravity of the electrolyte 1, the shape of the vessel 2 and so on, the circular flows can be formed in the electrolyte 1 in the respective portions 3*a*, 3*b* and 4 and, at the same time, an overall circulation of the electrolyte can be effected from the portion 4 through the sections 3*a* and 3*b* and back to the portion 4 as shown by the arrows on FIG. 1. In this connection, it is also possible, if necessary or desired, to provide a further closed loop flow, at what may be called a particle arranging portion, in the electrolyte 1 in an intermediate portion 14 between the portion 4 and section 3*a*. When the circular flow of the electrolyte 1 is formed in the intermediate portion 14, the electrolyte flow is introduced indirectly from the lower temperature portion 3 to the higher temperature portion 4 and the electrolyte 1 is sufficiently heated and fused in the portion 4. Thereafter, the electrolyte 1, which is well heated and hence fused, is fed indirectly to the cooling section 3*a*, so that the particles of the precipitated crystallites and their quality can be adjusted or controlled or the arrangement of the particles can be achieved at will.

Figure 5:
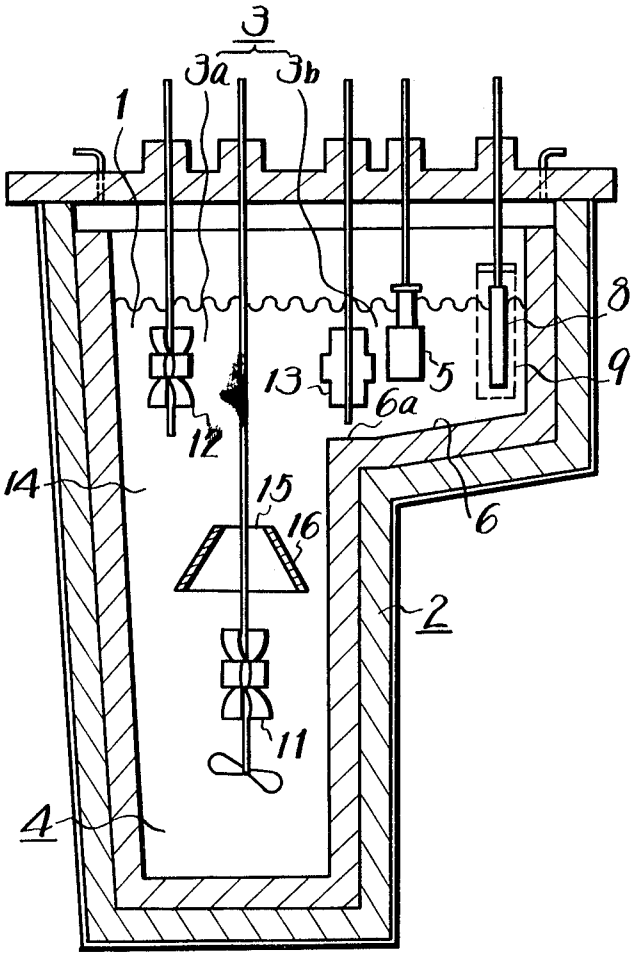

FIG. 5 shows another embodiment of an electrolyzer according to the present invention in which the parts corresponding to those described above with reference to FIGS. 1 to 4 are identified by the same reference numerals. In the embodiment shown in FIG. 5, a separator 16 which is provided with a central bore 15 and is of a conical shape is disposed between the higher and lower temperature portions 4 and 3 to divide the electrolyte flow into two parts in the higher and lower temperature portions 4 and 3 and hence to increase the recovery efficiency of electrolyte in the portion 4.

Figure 6:
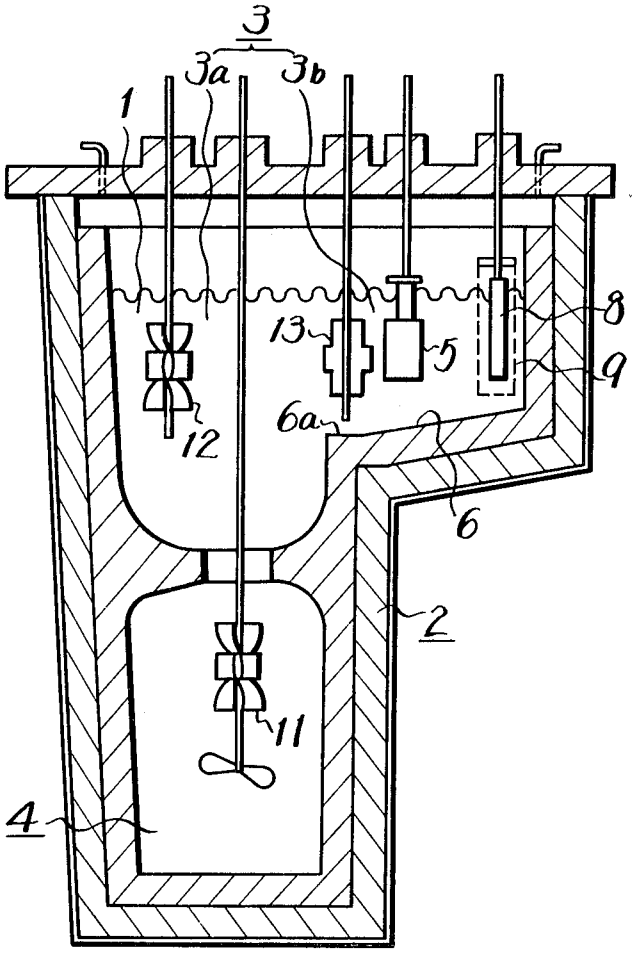
FIGS. 5, 6 and 7 are cross-sectional views similar to FIG. 1, but respectively showing other embodiments of the invention.

In the example shown in FIG. 5, the separator 16 is provided independent of the vessel 2, but it may be possible that the separator is provided by a projecting portion of the inner wall of the vessel 2 itself, as shown at 16' in FIG. 6.

Figure 7:
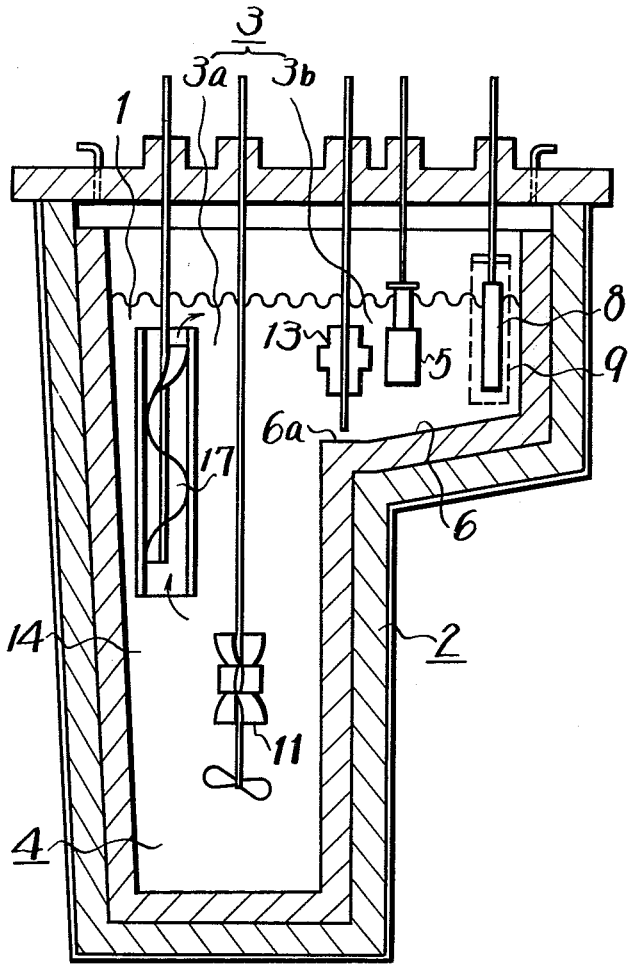

FIG. 7 shows still another embodiment of an electrolyzer according to the invention in which the parts corresponding to those described with reference to FIGS. 1 to 6 are again identified by the same reference numerals. In this example, a helical rotary blade 17 for conveying the electrolyte is provided in place of the stirrer 12 and extends from the intermediate portion 14 to the section 3*a* of the lower temperature portion 3. Thus, the electrolyte which has had its functional properties restored in the higher temperature portion 4 is conducted to the lower temperature portion 3.

The above examples of the invention employ three rotary blade mechanisms 11, 12 and 13 or 11, 13 and 17 to form the necessary electrolyte flows in the vessel, but it will be apparent that two or four or more rotary blade mechanisms may be used to form the necessary electrolyte flows.

When the metal to be electrodeposited on the cathode electrode is titanium, the composition of the electrolyte 1 may be as follows for the condition of the electrolytic temperature being selected at 451° to 445° C:

| | | |
|---|---|---|
| $BaCl_2$ | 21.5 | in weight ratio |
| $MgCl_2$ | 22.8 | " |
| $CaCl_2$ | 13.1 | " |
| $NaCl_2$ | 12.3 | " |
| KCl | 9.3 | " |
| $TiCl_2$ | 15.3 | " |
| $TiCl_3$ | 0.5 | " |

In the case that the electrolyte with the above composition is used as the electrolyte 1, titanium pieces or titanium sponge (which is not of such high purity and quality as the titanium to be obtained finally) is disposed on the bottom of the higher temperature or deep portion 4 to produce $Ti^{2+}$ component by the reaction of the titanium piece or sponge with $Ti^{3+}$ component which may be produced in the electrolyte, whereby to control the concentration of $Ti^{3+}$ component in the electrolyte and to keep the electrolyte at a desired composition.

With an electrolyzer according to the present invention as described above, in the cathode or electrolytic section 3*b* of the lower temperature portion 3 in which the cathode electrode 5 is disposed, the electrolyte is kept at the predetermined temperature and a part of the salts composing the fused salts if dispersed in the electrolyte as solid particles in a favourable state. Thus, good electrodeposition is carried out. Further, the electrolyte in the section 3*b* is circulated or returned to the higher temperature portion 4, so that the electrolyte is sufficiently fused in the portion 4 and its functional properties are restored therein. Thereafter, the electrolyte is fed back to the lower temperature portion 3 again. Since the bottom surface 6 provided under the section 3*b* is inclined down to the portion 4, even if excess salts precipitated in the cathode section 3*b* settle upon the inclined bottom 6, such precipitated salts are fed to the portion 4 with the overall circular flow of the electrolyte.

Further, the circular flows of the electrolyte are produced in the higher temperature portion 4, the cooling portion 3*a* of the section 3 and the cathode or electrolytic section 3*b*, respectively, and the electrolyte is circulated as a whole flow among such portions of vessel 2 so that the time periods of the electrolyte in the respective portions can be selected desirably. In other words, the process by which the electrolyte recovers is functional properties in the higher temperature portion 4, the process of dispersion of the solid particles in the cooling section 3*a* of the lower temperature portion 3, and the electrolytic process in the cathode section 3*b* are carried out in a circular or continuous manner.

Further, when the cathode electrode 5 is moved, for example, rotated, the metal electrodeposited thereon is smooth and of good quality.

It will be apparent that many modifications and variations could be effected in the described embodiments of the invention by those skilled in the art without departing from the spirit and scope of the invention as defined in the appended claims.

We claim as our invention:

1. An electrolyzer comprising a vessel containing an electrolyte, said vessel having a first portion having a cooling means for maintaining a relatively low temperature in which the electrolyte therein is maintained at a relatively low temperature and a second portion having a heating means for maintaining a relatively high temperature in which the electrolyte therein is maintained at a relatively high temperature, cathode and anode electrodes immersed in the electrolyte in said first portion of the vessel, and a plurality of stirring members disposed in said cooling and electrolyte sections of said first and second portions for producing circular flows of the electrolyte within said first and second portions, respectively, of the vessel and within said vessel as a whole between said first and second portions so as to achieve substantially continuous electrolysis, said vessel being relatively deep at one side and relatively shallow at the other side, said second portion being defined at the bottom of said relatively deep side, said cooling section being defined at the top of said relatively deep side and at said relatively shallow side, and said electrolyte section being defined by said relatively shallow side.

2. An electrolyzer according to claim 1; in which a separator is disposed between said anode and cathode electrodes.

3. An electrolyzer according to claim 2; in which said separator is constituted by a porous membrane surrounding said anode electrode in the electrolyte.

4. An electrolyzer according to claim 1; in which said cathode electrode is movable within said first portion of the vessel for attaining smooth electrodeposition thereon.

5. An electrolyzer according to claim 1; further comprising means defining a partition which partly separates said first and second portions of the vessel from each other.

6. An electrolyzer according to claim 1; in which said first portion of the vessel has a cooling section and an electrolytic section disposed side-by-side with said anode and cathode electrodes being disposed in said electrolytic section, and said circular flow of the electrolyte within the vessel as a whole is in the direction from said second portion through said cooling section to said electrolytic section and from the latter back to said second portion.

7. An electrolyzer according to claim 6; further comprising means providing a partial separation between said cooling and electrolytic sections of said first portion of the vessel.

8. An electrolyzer according to claim 1; in which said relatively shallow side of the vessel has a bottom surface which slopes downwardly toward said relatively deep side for returning to said second portion any excess salts which precipitate from the electrolyte in said electrolytic section.

9. An electrolyzer according to claim 1; in which said means for producing the circular flows of the electrolyte includes respective rotary stirrers disposed in said electrolytic section and in said second portion, and an additional rotary stirrer extending from said cooling section into the region of said relatively deep side of the vessel intermediate said cooling section and said second portion.

* * * * *